United States Patent [19]

Clement

[11] 4,086,901

[45] May 2, 1978

[54] MISSILE PROPELLING DEVICE AND MISSILE THEREFOR

[76] Inventor: Joseph J. Clement, 1220 Denarvaez Ave., Bradenton, Fla. 33505

[21] Appl. No.: 724,777

[22] Filed: Sep. 20, 1976

[51] Int. Cl.[2] ..... F41B 7/00

[52] U.S. Cl. ..... 124/21; 273/106.5 R; 124/83

[58] Field of Search ..... 124/21, 17, 22, 35 A, 124/41 R, 26, 23 R, 24 R, 86, 88, 90, 16, 25; 273/106.5 R, 58 R, 58 A, 58 B, 58 J, 106

[56] References Cited

U.S. PATENT DOCUMENTS

| | | | |
|---|---|---|---|
| 1,457,983 | 6/1923 | Malone | 124/88 X |
| 1,526,176 | 2/1925 | O'Connell | 124/35 A X |
| 2,069,821 | 2/1937 | Douglas | 124/24 R |
| 2,247,649 | 7/1941 | Brooke | 124/90 X |
| 2,287,636 | 6/1942 | Hayter | 124/21 |
| 2,370,783 | 3/1945 | Dritz | 124/24 R |
| 3,923,036 | 12/1975 | Jennings et al. | 124/24 R X |

FOREIGN PATENT DOCUMENTS

| | | | |
|---|---|---|---|
| 815,921 | 7/1959 | United Kingdom | 124/23 R |

*Primary Examiner*—William R. Browne

*Attorney, Agent, or Firm*—Walter M. Rodgers; Walter A. Rodgers

[57] ABSTRACT

A missile propelling device includes a rigid bow having an ejection tube formed integrally with the bow and disposed intermediate the ends thereof, a plurality of parallel guide rods having corresponding ends thereof secured about the periphery of said ejection tube to define an elongated missile guiding passage whose axis is aligned with the axis of said ejection tube, an elastic string attached to the ends of said bow and having its midportion disposed between preselected guide rods and astride said missile guiding passage, an end cap secured to the ends of said guide rods remote from said ejection tube, and a hook mounted on said end cap and arranged releasably to engage the midportion of said string so that a missile disposed in said elongated missile guiding passage is propelled outwardly therethrough and through said ejection tube in response to release of said string from said hook.

9 Claims, 6 Drawing Figures

MISSILE PROPELLING DEVICE AND MISSILE THEREFOR

Missile propelling means utilizing rigid slingshot prongs or bows and resilient elastic type propelling means associated therewith are known. Such known devices generally utilize a percussion element associated with the elastic means for engaging a missile to be propelled. Of course such percussion elements are characterized by substantial inertia and may in some instances damage the missile due to sudden impact therewith.

According to this invention, in one form, a rigid bow is provided with an elastic string and the elastic string is controlled in such manner that the midportion thereof directly engages a missile to be propelled outwardly through an ejection tube and through an aligned elongated missile guiding passage at one end of which the missile is initially positioned. The missile guiding passage is defined by a plurality of parallel guide rods affixed at corresponding ends about the periphery of the ejection tube and an end cap having hook means associated therewith is secured to the ends of the guide tubes remote from the ejection tube. The elastic bow string is interposed between preselected guide rods in such manner that irrespective of the position of the elastic bow string, the midportion thereof is positively secured in a diametrically disposed arrangement so that positive and certain engagement of the missile by the elastic string is insured.

For a better understanding of the invention reference may be had to the following detailed description taken in conjunction with the accompanying drawing in which FIG. 1 is a perspective view of a missile propelling device showing the missile in firing position;

FIG. 4 is a view of two component parts which are utilized in the formation of a missile such as is depicted in assembled form in FIG. 5; and in which

Figure 6:
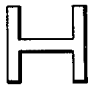
FIG. 6 is a cross sectional view taken on the line 6—6 in FIG. 2.

In the drawings the numeral 1 generally designates a rigid bow structure which as is indicated in FIG. 6 is H-shaped in cross section. A pair of transverse slots 2 and 3 are formed in the ends of the bow 1 and receive the ends of elastic string 4 in the ends of which knots 5 and 6 are formed. From FIGS. 1 and 2 it is apparent that slot 2 extends in a transverse direction opposite from the direction in which slot 3 extends.

Formed integrally with bow 1 is an ejection tube 7. A plurality of sockets 8, 9, 10 and 11 are integrally formed in the ejection tube 7 and receive corresponding ends of guide rods **12, 13, 13*a* and 14, guide rod 13*a* being immediately behind rod 13 as viewed in FIGS. 1 and 2. As viewed in FIG. 1, string 4 is disposed rearwardly of rod 14 and forwardly of rod 12. Thus the fact that string 4 is on the opposite side of rod 14 from the direction in which slot 2 extends insures that a sidewise component of force is applied to string 4 which insures that the string is retained within slot 2. Similarly a sidewise force is imparted by rod 12 which insures that the string 4 remains securely within transverse slot 3**.

The rods 12, 13, 14 and **13*a* define an elongated missile guiding passage whose axis is aligned with the axis of ejection tube 7**.

Figure 2:
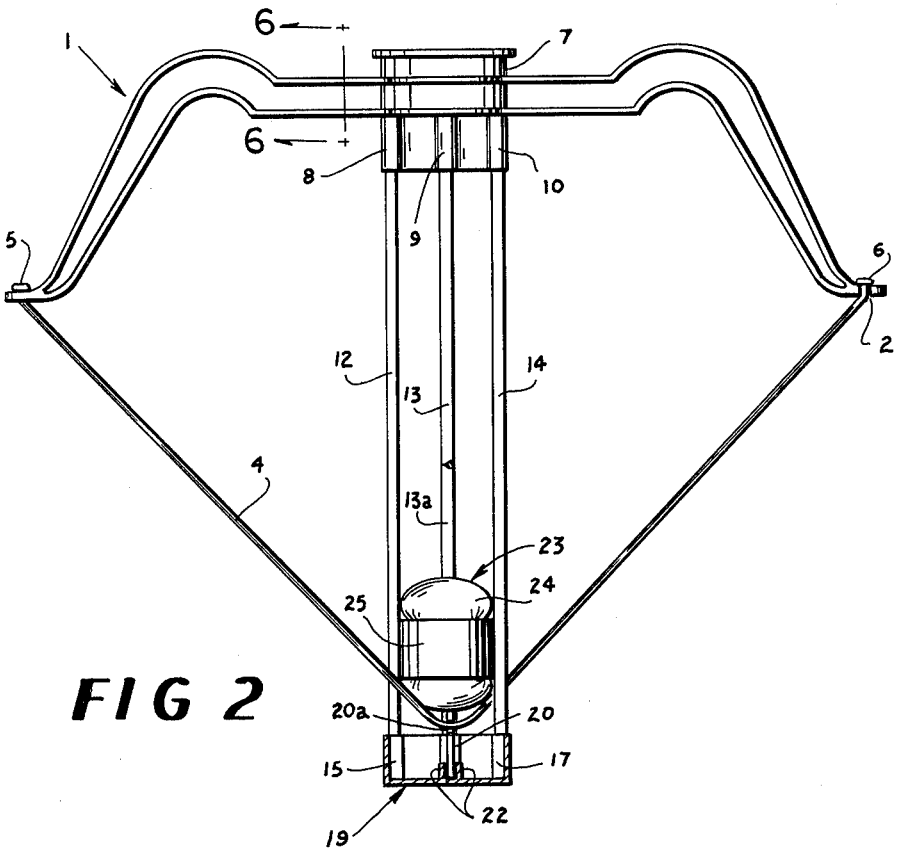
FIG. 2 is a side view partially in cross section similar to FIG. 1.
Figure 3:
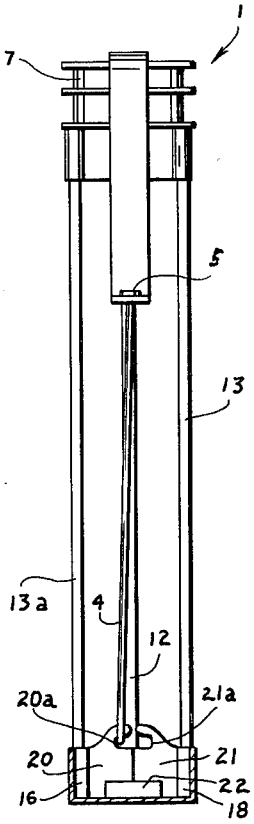
FIG. 3 is an end view of FIG. 2 as seen from the left side thereof.

The ends of the guide rods such as 12, 13, 14 and **13*a* opposite from the ends which are mounted within sockets 8-11 are mounted in sockets 15, 16, 17 and 18 formed integrally with end cap 19. Hook element 20 is integrally formed with rod 13*a* while hook element 21 is integrally formed with rod 13. A pair of ribs are formed integrally with the bottom of end cap 19 and are indicated in FIGS. 2 and 3 by the numeral 22. Hook elements 20 and 21 are interposed between spaced apart parallel ribs 22. Hook element 20 is provided with a laterally extending hook 20*a* while hook element 21 is provided with a similar laterally extending hook 21*a***.

Figure 1:
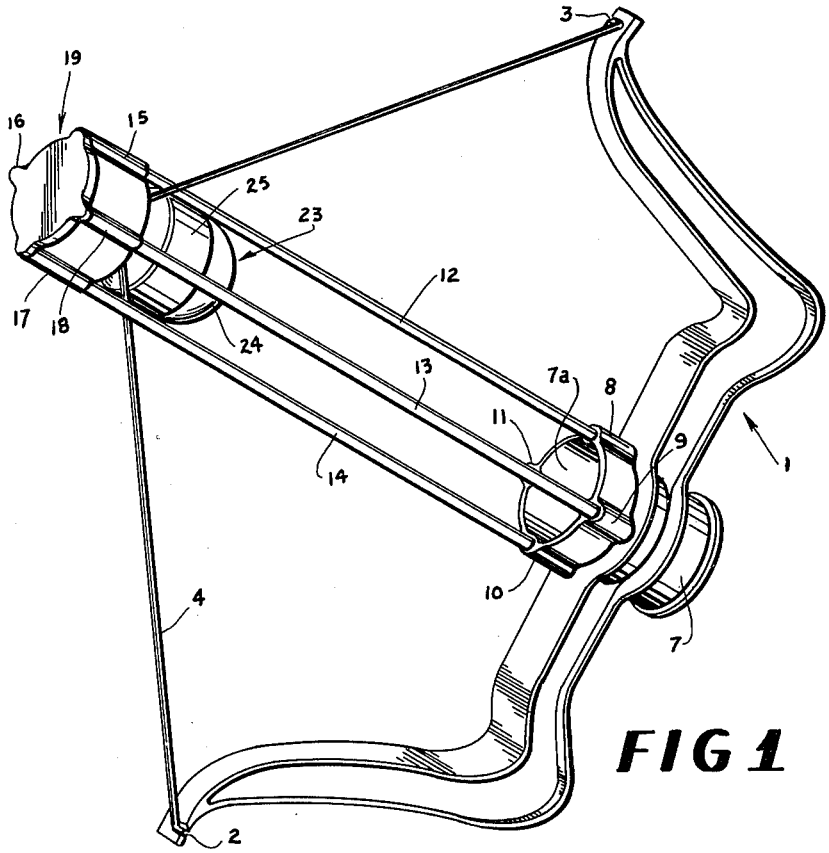

As is apparent in FIGS. 1 and 2, the string 4 when stretched as shown in the drawings and when hooked over either hook **20*a* or 21*a* is maintained in its stretched position as illustrated. When the string is released from hook 20*a* or 21*a* manually, the missile generally designated at 23 is propelled outwardly through the elongated missile guiding passage defined by guides 12, 13, 14 and 13*a* and through ejection tube 7**.

Figure 4:
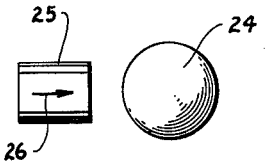
Figure 5:
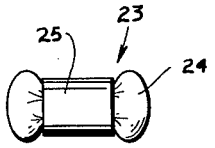

The missile 23 may take any number of forms such as spherical or the shape illustrated in FIGS. 1, 2 and 5. The arrangement shown in FIG. 5 for example is a composite structure formed of a sphere 24 and a band 25. The sphere 24 is formed of resilient compressible material and is of a diameter somewhat greater than the diameter of the band 25 which is formed of a nonstretchable material. Thus in order to form the assembly shown in FIG. 5 from the elements shown in FIG. 4, the sphere 24 is compressed sufficiently to allow the nonstretchable band 25 to envelope the sphere as shown in FIG. 5. This arrangement provides an elongated structure the outer dimensions of which are compatable with the inner dimensions of ejection tube 7 and of the elongated missile guiding passage defined by guide rods 12, 13, 14 and **13*a* so that the missile may freely pass therethrough and through the ejection tube 7**.

In order to insure free sliding movement of the missile 23 relative to the missile guiding passage defined by the guide rods and by the ejection tube 7, the innermost parts of the guide rods **12, 13, 13*a* and 14 project inwardly somewhat from the inner surface 7*a* of ejection tube 7 so that no impact or collision will occur at this junction and so as to provide surfaces to which cement can be applied to secure the rods to the tube 7**.

According to a feature of the invention, the string 4 is positively precluded from sliding past the missile 23 due to the fact that the string 4 is disposed in back of one of the rods such as 14 and in front of another diametrically disposed rod such as 12 to insure that the midportion of the string 4 is diametrically disposed and incapable of deforming and sliding alongside and between the missile 23 and the inner surfaces of the guide rods **12, 13, 13*a* and 14. By this means positive interaction between the string 4 and the missile such as 23** is insured.

Furthermore the bow itself must be of a rigid and precise construction and such is insured by the fact that the bow is formed with an H-shaped cross section and requires a minimum of material.

The bow 1 also is formed with straight sections on opposite sides of the ejection tube 7 thus providing convenient hand gripping space. Of course normally one hand is used to grasp the bow and the other hand is used to stretch the string 4 about the hooks **20*a* or 21*a*. After the missile 23 is inserted through the ejection tube 7 and downwardly through the missile guiding passage defined by guide rods 12, 13, 13*a* and 14 to occupy the position shown in the drawing, the device is then ready for discharge. Such discharge is achieved manually by simply dislodging the midportion of the elastic string 4 from the hook 20***a* or 21*a* as the case may be.

The embodiments of the invention in which an exclusive property or privilege is claimed are defined as follows:

1. A missile propelling device comprising a rigid bow, an ejection tube forming a part of said bow and disposed intermediate the ends thereof and arranged to receive and guide a missile in a direction transverse to said bow, a plurality of parallel guide rods whose corresponding ends are secured about the periphery of said ejection tube to define an elongated missile guiding passage whose axis is aligned with the axis of said ejection tube, a pair of diametrically opposite guide rods being arranged with their axes in the plane of said bow and said string being disposed therebetween to position the midportion thereof diametrically of said missile guiding passage, an elastic string attached to the ends of said bow and having its midportion disposed between preselected guide rods and astride said missile guiding passage, an end cap secured to the ends of said guide rods remote from said ejection tube, and hook means mounted on said end cap and arranged releasably to engage the midportion of said string, said string being engageable with a missile disposed in said missile guiding passage.

2. A device according to claim 1 wherein the innermost parts of said guide rods project inwardly somewhat from the inner surface of said ejection tube.

3. A device according to claim 1 wherein a transverse string receiving slot is formed in each end of said bow and wherein said slots extend in opposite directions.

4. A device according to claim 1 wherein said string is disposed on a side of one of said diametrically opposite guide rods which is opposite from the transverse direction in which the adjacent one of said slots extends and wherein an enlarged end portion is formed on each end of said string for cooperating with one of said slots to secure said string to said bow.

5. A device according to claim 1 wherein said string is disposed on the side of each of said pair of diametrically opposite guide rods which is opposite from the transverse direction in which the adjacent one of said slots extends.

6. A device according to claim 1 wherein said bow includes a substantially straight hand gripping portion on each side of said ejection tube and adjacent thereto.

7. A device according to claim 1 wherein said hook means comprises a hook element formed integrally with one of said guide rods.

8. A device according to claim 1 wherein said bow is H-shaped in cross section.

9. A device according to claim 1 wherein the missile comprises an initially spherically shaped ball of compressible material about which a band of substantially nonstretchable material is disposed and wherein the diameter of said band is less than the initial noncompressed diameter of said spherically shaped ball.

* * * * *